US011078638B2

(12) United States Patent
Hoe

(10) Patent No.: US 11,078,638 B2
(45) Date of Patent: Aug. 3, 2021

(54) TWIST AND LOCK REMOVABLE BOLLARD

(71) Applicant: J.R. Hoe & Sons, Middlesboro, KY (US)

(72) Inventor: Harry H. Hoe, Middlesboro, KY (US)

(73) Assignee: J. R. HOE & SONS, Middlesboro, KY (US)

( * ) Notice: Subject to any disclaimer, the term of this patent is extended or adjusted under 35 U.S.C. 154(b) by 22 days.

(21) Appl. No.: 16/673,264

(22) Filed: Nov. 4, 2019

(65) Prior Publication Data

US 2020/0263375 A1 Aug. 20, 2020

Related U.S. Application Data

(60) Provisional application No. 62/726,596, filed on Sep. 4, 2018.

(51) Int. Cl.
*E01F 13/04* (2006.01)
*E01F 13/02* (2006.01)

(52) U.S. Cl.
CPC ..... *E01F 13/026* (2013.01)

(58) Field of Classification Search
CPC ..... E01F 13/024; E01F 13/026; E01F 13/04
USPC ..... 40/607.02, 607.04, 607.06, 607.07, 40/607.08, 607.1; 403/349
See application file for complete search history.

(56) References Cited

U.S. PATENT DOCUMENTS 1,536,559 A * 5/1925 Carroll ..... E04H 12/2269 52/297
3,933,011 A * 1/1976 DiGilio ..... A44C 17/0208 63/29.1
4,176,815 A * 12/1979 Davidson ..... F16F 1/128 248/589
7,472,891 B2 * 1/2009 Schram ..... E05B 53/00 256/65.14
7,722,285 B2 * 5/2010 Schram ..... E05B 53/00 404/6

(Continued)

FOREIGN PATENT DOCUMENTS

EP 3128080 A1 2/2017

OTHER PUBLICATIONS

Saevarsdottir, S. (2014) Removable Bollard Design for the Royal Parks in London. 2014, University of Skovde Bachelor Degree Program.

(Continued)

*Primary Examiner* — Gary S Hartmann
(74) *Attorney, Agent, or Firm* — King & Schickli, PLLC

(57) ABSTRACT

A bollard assembly includes a post including at least one locking flange or pin and a cooperating base defining a post receiver. The base includes at least one interior wall including at least one cooperating locking groove dimensioned and configured to receive an end of the at least one locking flange or pin. The at least one cooperating locking groove includes at least one portion defining a substantially vertical pathway and at least one intersecting portion defining a substantially horizontal pathway. The at least one cooperating locking groove may defined by a top portion and a bottom portion each defining a substantially vertical pathway, and an intersecting intermediate portion defining a plane oriented substantially perpendicularly to the top portion and the bottom portion.

14 Claims, 1 Drawing Sheet

(56) References Cited

U.S. PATENT DOCUMENTS

| | | | | |
|---|---|---|---|---|
| 8,202,020 | B2 * | 6/2012 | Hughes, Jr. ..... | E01F 9/588<br>404/9 |
| 8,297,873 | B1 | 10/2012 | Schram et al. | |
| 2006/0204327 | A1 | 9/2006 | Phelan | |
| 2008/0304909 | A1 | 12/2008 | McCue et al. | |
| 2010/0086350 | A1 * | 4/2010 | Schram ..... | E01F 13/026<br>404/11 |
| 2013/0192149 | A1 | 8/2013 | Roach | |

OTHER PUBLICATIONS

EP 3128080 A1—English machine translation.

* cited by examiner

TWIST AND LOCK REMOVABLE BOLLARD

This is a utility patent application claiming priority to U.S. provisional patent application Ser. No. 62/726,596 filed on Sep. 4, 2018, the full disclosure of which is incorporated herein in its entirety by reference.

TECHNICAL FIELD

This disclosure relates to bollards for use in restricting access, such as by a vehicle, to a defined area. In particular, the disclosure relates to a twist-and-lock removable bollard.

BACKGROUND

Conventional bollards are public security devices typically comprising a post of suitable durability, height, width, etc., sunk into the ground to block entry to an area to which vehicular access is to be denied or restricted. Conventional practice deploys a plurality of bollards which are arrayed in a spaced-apart relationship to define a physical barrier in front of the area to which access is to be denied or restricted. The spaced-apart relationship of the plurality of bollards may be such that entry by pedestrians is possible but not entry by vehicles such as cars, trucks, carts, motorcycles, bicycles, etc.

Conventional bollards are typically permanently or semi-permanently embedded in the ground, e.g., in a concrete pad. Alternatively, such bollards may require a padlock or other mechanical locking system to prevent theft or inadvertent removal. This complicates removal of the bollards when access by vehicles, etc. to a protected area is desired or when the desired period of restricted vehicular access is terminated.

SUMMARY

In accordance with the purposes and benefits described herein, a self-locking bollard assembly is provided comprising a post including at least one locking flange or pin and a cooperating base. The assembly may comprise a plurality of posts and a corresponding plurality of cooperating bases.

The cooperating base defines a post receiver and includes at least one interior wall having at least one cooperating locking groove dimensioned and configured to receive an end of the at least one locking flange or pin. The at least one cooperating locking groove includes at least one portion defining a substantially vertical pathway and at least one intersecting portion defining a substantially horizontal pathway. In one possible embodiment, the at least one cooperating locking groove is defined by a top portion and a bottom portion each defining a substantially vertical pathway, and an intersecting intermediate portion defining a plane oriented substantially perpendicularly to the top portion and the bottom portion.

In embodiments, the bollard post includes a plurality of locking flanges or pins and the cooperating base includes a corresponding of cooperating locking grooves each disposed to receive a one of the plurality of locking flanges or pins. A through-bore may be provided in a top portion of the post to receive a lever therethrough. The base may include at least one ground anchor, and optionally a base cover or plug may be provided.

In the following description, there are shown and described preferred embodiments of a twist-and-lock removable bollard system according to the present disclosure. As it should be realized, the device is capable of other, different embodiments and its several details are capable of modification in various, obvious aspects all without departing from the method and product as set forth and described in the following claims. Accordingly, the drawings and descriptions should be regarded as illustrative in nature and not as restrictive.

BRIEF DESCRIPTION OF THE DRAWINGS

The accompanying drawing figures incorporated herein and forming a part of the specification, illustrate several aspects of the method and product of the method and together with the description serve to explain certain principles thereof. In the drawing figures.

Reference will now be made in detail to the present preferred embodiments of the twist-and-lock removable bollard, examples of which are illustrated in the accompanying drawing figures.

DETAILED DESCRIPTION

Figure 1:
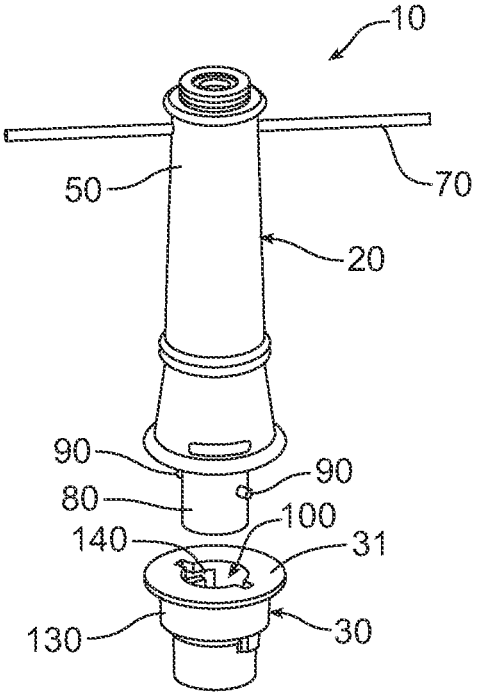
FIG. 1 shows a twist-and-lock removable bollard system according to the present disclosure.
Figure 2:
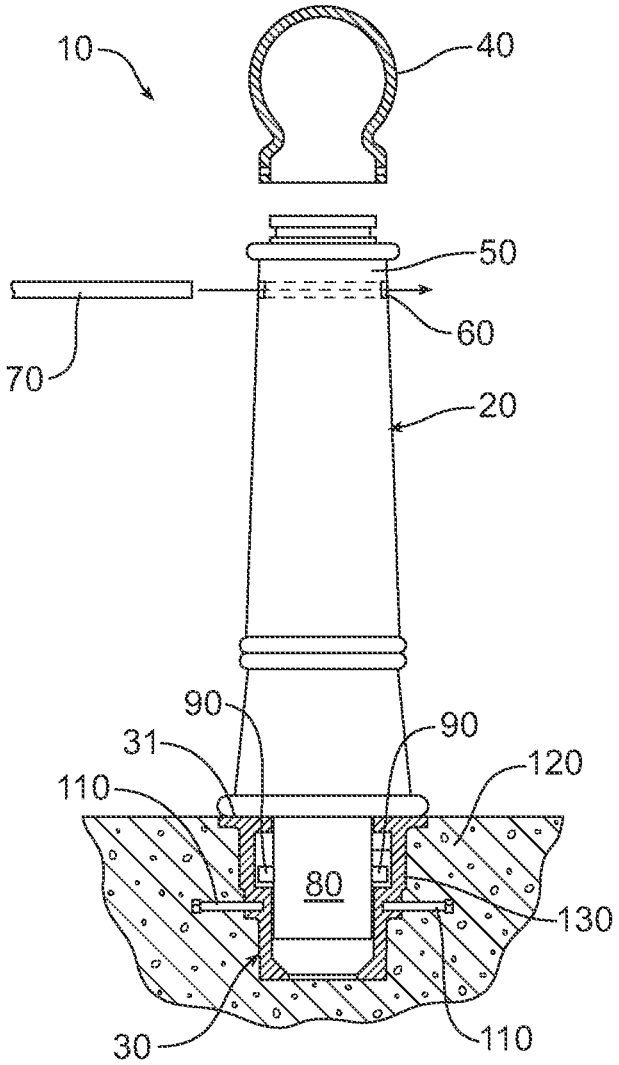
FIG. 2 shows the removable bollard system of FIG. 1 positioned in a concrete pad or other ground-engaging construct.

With reference to FIG. 1, a removable bollard assembly 10 is provided including a post 20, a cooperating base 30, and optionally a top cap 40 (see FIG. 2). The post 20 may include a top end 50 having a through-bore 60 (see FIG. 2) to accommodate a lever 70 useful in installing and removing the removable bollard 10. The post 20 further includes a bottom end 80 including at least one locking flange or pin 90, the purpose of which will be described below. In the depicted embodiment locking two flanges or pins 90 are provided, although of course more or fewer flanges or pins may be included as needed or as desired. The depicted embodiment of the post 20 is substantially cylindrical in cross-section, but as will be appreciated all or a portion of the post may define a different cross-sectional shape, such as square, rectangular, or other shapes. As examples, it is known to provide bollards defining in cross-section a column, a half-pipe, a pyramid, and others. Optional caps (not shown) may be provided to cover the ends of through-bore 60 when not in use.

The cooperating base 30 defines a receiver 100 dimensioned and configured to receive the bottom end 80 of the post 20 and a top lip or flange 31 defining a mating surface adapted to support the weight of the post 20. With reference to FIG. 2, the base 30 may further include one or more ground anchors 110 adapted to assist in retaining the base in place in the ground 120. Ground anchors 110 may in one possible embodiment be concrete anchors of a type known in the art for retaining base 30 in a concrete pad into which the removable bollard post 20 is to be placed. A base 30 cover or plug (not shown) 32 may be provided to allow covering the base receiver 100 when not actively receiving a post 20 therein. The base cover or plug 32 may desirably be fabricated to fit into the base to provide a surface that is substantially flush with a surface of the concrete pad or the ground, reducing the hazard of tripping by pedestrians.

Figure 3:
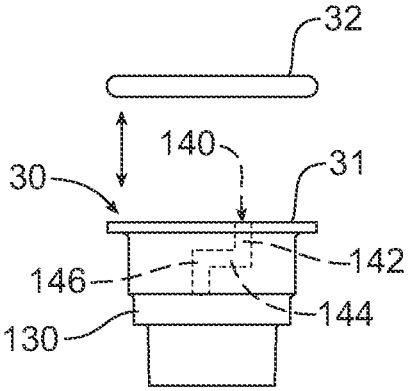
FIG. 3 is a side view of a base for a twist-and-lock removable bollard system according to the present disclosure.

The base 30 includes at least one interior wall 130 including at least one locking groove 140 (see also FIG. 3) therein. It will be appreciated that the number of locking grooves 140 may correspond to the number of locking flanges or pins 90, and further that each of the locking grooves 140 will be dimensioned, configured, and disposed in the base receiver 100 to receive a locking flange or pin 90 therein. Each locking groove 140 includes at least one portion defining a substantially vertical pathway and at least one portion defining a substantially horizontal pathway that is substantially perpendicular to the vertical pathway.

The configuration of the locking groove 140 allows the post 20 to be inserted into the receiver 100 whereby each locking flange or pin 90 traverses down the at least one portion defining a substantially vertical pathway. The post 20 may then be rotated whereby each locking flange or pin 90 then traverses across the at least one portion defining a substantially horizontal pathway. This locks the post 20 in place to prevent removal from the base 30 by simply pulling the post 20 upwardly. In one possible embodiment, the locking groove 140 is a twist-and-lock groove defined by a first vertical path 142, an intersecting perpendicular path 144, and an intersecting second vertical path 146 (see FIG. 3).

In use, the base 30 may be embedded into a suitable ground surface 120, such as a concrete pad (see FIG. 2). Lever 70 is passed through through-bore 60 (see FIG. 1) to lift the post 20, and the post bottom end 80 is lowered into the base 30 by way of receiver 100 whereby each locking flange or pin 90 passes into a cooperating locking groove 140. By gravity and the weight of the post 20, each locking flange or pin 90 travels down the first vertical path 142 to the intersecting perpendicular path 144. The post 20 is then rotated sufficiently by application of force to lever 70 to traverse the locking flanges or pins 90 along the intersecting perpendicular path 144. Again by gravity and the weight of the post 20, the locking flanges or pins 90 then drop into the intersecting second vertical path 146, and thereby the post 20 is secured in place (see FIG. 2). To remove the post 20 from the base 30, this process is simply reversed. Optional security measures (not shown) may be provided to prevent unauthorized removal of the post 20 from the base 30, such as a lock or a surface bolt or screw.

It will be appreciated that the expedient of providing locking grooves 140 disposed in an interior wall of the base 30 and defined by at least one substantially vertical path provides as an additional benefit a locking structure which will tend not to accumulate debris over time. Even more, the action of installing and removing a post 20 from the base 30 as described above will have the desirable benefit of removing any debris which may have accumulated, i.e. providing a "self-cleaning" system. Such debris has the potential to interfere with the smooth operation of the locking structure described herein. As will also be appreciated, by the foregoing disclosure there is provided a self-contained, locking bollard unit that does not absolutely require extraneous machinery or additional exterior locks such as padlocks, although as noted above such structures may be optionally employed.

The foregoing has been presented for purposes of illustration and description. It is not intended to be exhaustive or to limit the embodiments to the precise forms disclosed. Obvious modifications and variations are possible in light of the above teachings. All such modifications and variations are within the scope of the appended claims when interpreted in accordance with the breadth to which they are fairly, legally and equitably entitled.

What is claimed:

1. A bollard assembly, comprising:

a post including a plurality of locking flanges or pins; and a cooperating base defined by at least:

a top lip or flange defining a mating surface adapted to support the weight of the post; and at least one interior wall defining a post receiver having a plurality of cooperating locking grooves defined therein, wherein each of the plurality of cooperating locking grooves is defined by a top portion and a bottom portion each defining a substantially vertical pathway, and an intersecting intermediate portion defining a plane oriented substantially perpendicularly to the top portion and the bottom portion;

wherein the plurality of locking flanges or pins are disposed to remove accumulated debris from an interior of the plurality of cooperating locking grooves on interlocking the post with or removing the post from the receiver.

2. The assembly of claim 1, further including a base cover or plug.

3. The assembly of claim 1, wherein a top portion of the post includes a through-bore for receiving a lever therethrough.

4. The assembly of claim 1, wherein the cooperating base includes at least one ground anchor.

5. A bollard system, comprising:

a plurality of posts each including a plurality of locking flanges or pins; and a plurality of cooperating bases each defined by at least:

a top lip or flange defining a mating surface adapted to support the weight of the post; and at least one interior wall defining a post receiver having a plurality of cooperating locking grooves defined therein, wherein each of the plurality of cooperating locking grooves is defined by a top portion and a bottom portion each defining a substantially vertical pathway, and an intersecting intermediate portion defining a plane oriented substantially perpendicularly to the top portion and the bottom portion.

6. The assembly of claim 5, further including a base cover or plug.

7. The assembly of claim 5, wherein a top portion of each post includes a through-bore for receiving a lever therethrough.

8. The assembly of claim 5, further including a plurality of post top caps.

9. The assembly of claim 5, wherein each cooperating base includes at least one ground anchor.

10. A bollard assembly, comprising:

a post including a plurality of locking flanges or pins; and a cooperating base defined by at least:

a top lip or flange defining a mating surface adapted to support the weight of the post; and at least one interior wall defining a post receiver having a plurality of cooperating locking grooves defined in but not through said at least one interior wall, each of the plurality of cooperating locking grooves being disposed and configured to receive an end of a one of the plurality of locking flanges or pins.

11. The assembly of claim 10, wherein each of the plurality of cooperating locking grooves is defined by a top portion and a bottom portion each defining a substantially vertical pathway, and an intersecting intermediate portion defining a plane oriented substantially perpendicularly to the top portion and the bottom portion.

12. The assembly of claim 10, further including a base cover or plug.

13. The assembly of claim 10, wherein a top portion of the post includes a through-bore for receiving a lever therethrough.

14. The assembly of claim 10, wherein the cooperating base includes at least one ground anchor.

* * * * *